United States Patent [19]

Bostick, Sr.

[11] Patent Number: 4,504,893

[45] Date of Patent: Mar. 12, 1985

[54] LAMP BANK

[76] Inventor: David B. Bostick, Sr., P.O. Box 331, Hopkinsville, Ky. 42240

[21] Appl. No.: 346,728

[22] Filed: Feb. 8, 1982

[51] Int. Cl.[3] ..... F21V 33/00

[52] U.S. Cl. ..... 362/253; 362/410; 362/412; D26/51

[58] Field of Search ..... 362/253, 410, 412, 414; D99/35; 109/23; 194/1 R, 97 R; 340/51, 53 P

[56] References Cited

U.S. PATENT DOCUMENTS

D. 204,795 5/1966 Dickerson ..... D26/51

1,032,119 7/1912 Dalzell ..... 362/412

4,356,903 11/1982 Lemelson ..... 340/51

*Primary Examiner*—Donald P. Walsh

*Attorney, Agent, or Firm*—Luedeka & Neely

[57] ABSTRACT

The specification discloses a lamp (10) having a base (12) with a pedestal (16) extending upwardly therefrom. A cap (66) or bullet (24) is removably seated on the top of the pedestal (16), and a slot (40) is formed in the pedestal beneath the cap (66) or bullet (24). A circular insert (42) is removably locked to a cylindrical cavity (44) by a locking mechanism (46). Access to a chamber (32) within the pedestal (16) is achieved by removing the insert (42) from the cavity (44).

9 Claims, 8 Drawing Figures

LAMP BANK

FIELD OF THE INVENTION

The present invention relates to personal banks for home use, and particularly relates to a bank concealed within a lamp for containing money.

BACKGROUND OF THE INVENTION

Most homes include numerous lamps, including table lamps, for illuminating rooms. Typically, these lamps include relatively large pedestals that are hollow. In most instances, chambers found within lamp pedestals are totally unused.

However, some uses of the interior of a lamp pedestals are known. For example, in U.S. Pat. No. 1,739,239, there is disclosed a lamp pedestal in a so-called smoker's lamp that includes several doors, compartments and chambers for containing smoking paraphernalia, such as cigarettes, pipe tobacco, and ashes. Other dissimilar uses of the interior space within a lamps pedestal are shown in U.S. Pat. Nos. 1,335,650 and 4,079,241.

None of these patents disclose the concept of providing a hidden bank within a lamp pedestal and, specifically, none of these patents disclose the lamp bank disclosed herein.

SUMMARY OF THE INVENTION

In accordance with the present invention, the lamp bank for receiving and concealing money includes a base for supporting the lamp bank, and a lamp pedestal extends upwardly from the base. The lamp pedestal is hollow and, thus, has a chamber formed therein for containing money. An access port is formed in the lamp pedestal for selectively accessing the chamber so that money can be conveniently removed from the chamber, and an input mechanism is formed in the pedestal adjacent to the top of the chamber for receiving and inputing money into the chamber. An illuminating mechanism, such as an electric light socket and bulb, is mounted on the pedestal for producing light.

In accordance with a more particular aspect of the present invention, the lamp bank includes a lock mechanism for selectively locking the access port to prevent undesired access to the chamber. The access port and lock mechanism, in accordance with one embodiment of the present invention, includes an aperture formed in the lamp pedestal adjacent to the base of the lamp pedestal and extending through the pedestal into the chamber. An insert is dimensioned to fit snuggly within the aperture, and a locking mechanism selectively locks the insert within the aperture.

In accordance with another aspect of the present invention, the input mechanism includes a mechanism for selectively concealing it. Such input mechanism may include a recess formed in the pedestal and a slot formed in the pedestal within the recess extending through the pedestal and into the chamber so that money can be inserted therein. A plug or cap is dimensioned for fitting or seating snuggly within the recess to conceal the slot. Thus, the plug or cap normally conceals the slot, but may be removed so that money can be inserted into the lamp pedestal.

In accordance with another particular embodiment of the present invention, the lamp bank includes a rod extending from the bottom to and through the top of said pedestal and extending upwardly from the top of the pedestal for a predetermined distance. Illuminating means are mounted on the upper end of the rod. A cap is removably seated on the pedestal, and an aperture is formed in the cap for receiving the rod so that the cap may be raised from the pedestal and slideably translated along the rod. A slot is formed in the pedestal beneath the cap so that the cap normally conceals the slot but may be moved upwardly along the rod to expose the slot.

BRIEF DESCRIPTION OF THE DRAWINGS

The present invention may best be understood by reference to the Detailed Description when considered in conjunction with the accompanying Drawings in which.

DETAILED DESCRIPTION

Figure 1:
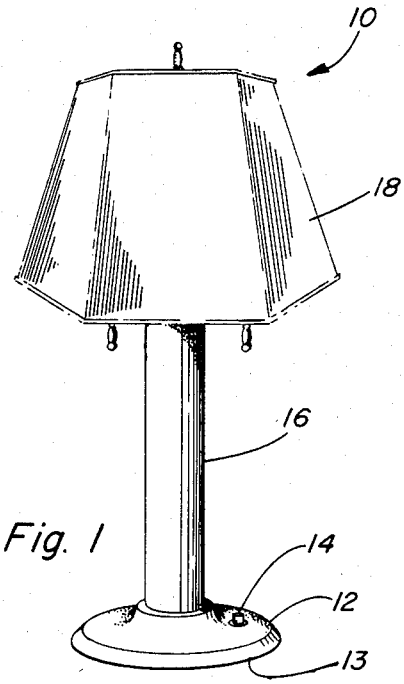
FIG. 1 is a front view of a lamp embodying the present invention.

Referring now to the Drawings in which like reference characters designate like or corresponding parts throughout the several views, there is shown in FIG. 1 a lamp 10 embodying the present invention. Althought the lamp disclosed herein, such as lamp 10, are in actuality lamp banks, as well as lamps, for purposes of clarity only, they will be referred to in the Detailed Description as lamps.

Lamp 10 includes a disc shaped base 12 having a planar underside 13 for resting on a planar surface such as a table. The base 12 includes a switch 14 for turning "on" and "off" an electrical lamp in the conventional fashion. A lamp pedestal 16 extends upwardly from the base 12, and a lampshade 18 is mounted on the top of the pedestal 16 concealing the illuminating mechanism.

Figure 2:
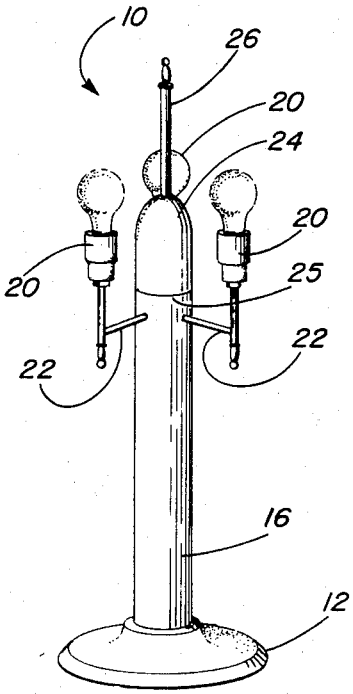
FIG. 2 is another front view of the lamp as shown in FIG. 1, but with the lampshade removed.

Referring now to FIG. 2, there is shown a front view of the lamp 10 with the lampshade 18 removed. In this view, it may be appreciated that the lamp 10 includes a plurality of electrical sockets and bulbs 20 mounted adjacent to the top of the pedestal 16 by tubing 22. Although not shown, it will be appreciated that electrical wiring extends from the base 12 up through the pedestal 16, and through the tubing 22 to each of the electrical sockets and bulbs 20.

In this embodiment, the pedestal 16 is a brass tube or cylinder, and a cylindrical bullet 24 is seated in the top of the cylinder 16. The bullet 24 has a lower outside cylindrical diameter equivalent to the diameter of the pedestal 16 so that the outside surfaces of the pedestal 16 and the bullet 24 form a smooth union along a circular interface 25.

A spire 26 extends upwardly from the top of the bullet 24 and appears to function primarily as decoration. However, the spire 26 is useful in removing the bullet 24 from its seat on the circular interface 25 without touching the electrical sockets and lightbulbs 20, and the spire may support a lamp shade such as shade 18.

Figure 3:
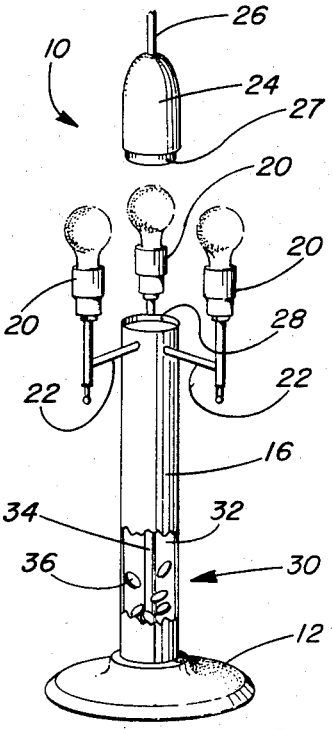
FIG. 3 is a front view of the lamp of FIG. 1 with a plug or cap removed therefrom to reveal a concealed input mechanism.

In FIG. 3, the bullet 24 is shown in a position removed from the pedestal 16 and moved upwardly therefrom. It will be apprciated that the bullet 24 includes a cylindrical plug 27 extending downwardly therefrom and being dimensioned to fit snuggly within a recess 28 formed at the top of the pedestal 16. Both the plug 27 and the recess 28 have a circular cross section.

Referring now to the lower portion of the lamp 10 in FIG. 3, there is shown a section 30 of the pedestal 16 in a broken away view to reveal the chamber 32 within the pedestal 16. Tubing 34 is shown in the section 30 extending a direction parallel to the pedestal 16. The tubing 34 extends from the base 12 to the tubing 22 so that electrical wiring may be inserted through the tubing 34 to the electrical sockets and lightbulbs 20 without exposing the chamber 32 to such electrical wiring. In this view, it is also shown that the chamber 32 may contain money, such as the coins 36.

Figure 4:
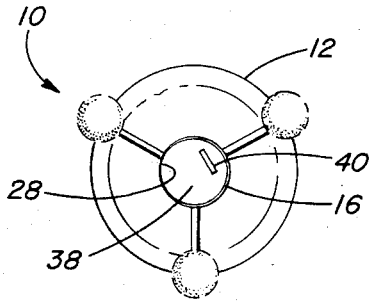
FIG. 4 is a top view of the lamp of FIG. 1 disclosing a recess formed in the top of the lamp pedestal with a slot formed therein.

Referring now to FIG. 4, there is shown a top view of the lamp 10 disclosing the recess 28. The bottom surface of the recess 28 is formed by a circular disc 38, and a slot 40 is formed in the disc 38 for receiving coins, money and the like into the chamber 32 within the pedestal 16. It will be appreciated by reference to FIGS. 2, 3 and 4, that the slot 40 is normally concealed by the bullet 24.

Figure 5:
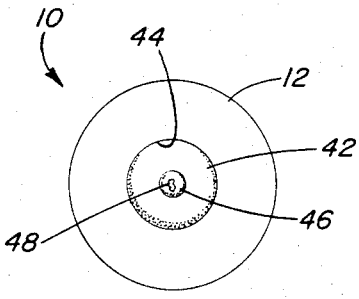
FIG. 5 is a bottom view of the lamp of FIG. 1 disclosing an access port and locking mechanism.

Referring now to FIG. 5, there is shown a bottom view of the lamp 10. In this view, it may be appreciated that a cylindrical cavity 44 is formed in the center of the base 12, and circular insert 42 is dimensioned to fit snuggly within the cavity 44. Mounted in the center of the insert 42 is conventional locking mechanism 46 that includes a keyhole 48. The locking mechanism 46 operates to lock the insert 42 in the cavity 44. By inserting a key into the keyhole 48, the locking mechanism 46 is unlocked, and the insert 42 may be removed to expose and provide access to the chamber 32 formed within the pedestal 16.

Figure 6:
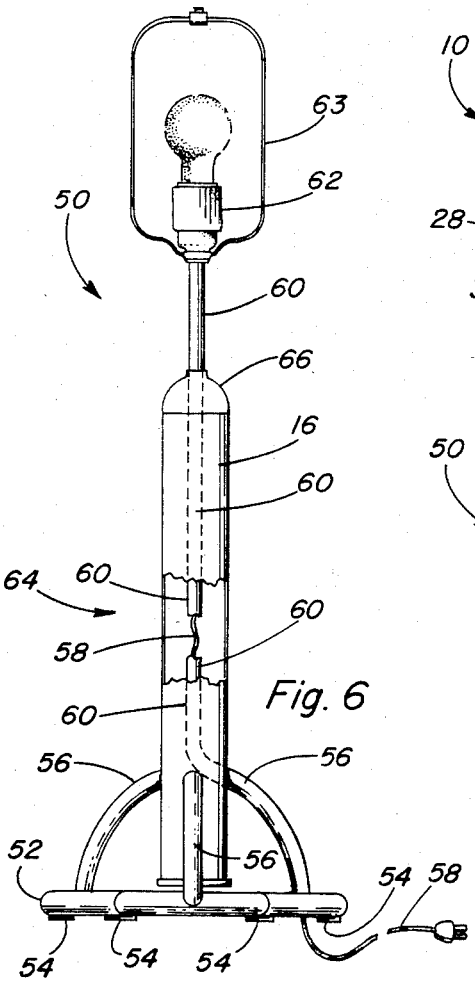
FIG. 6 is a front view of another embodiment of the present invention shown without a lampshade.

In FIG. 6, there is shown a lamp 50 that is an alternate embodiment of the present invention. The lamp 50 includes a tubular base 52 with a plurality of rubber feet 54 mounted on the bottom thereof. Three arched tubes 56 extend upwardly and inwardly from the base 52 and are attached to the lamp pedestal 16 which is substantially identical to the lamp pedestal 16 shown in FIG. 1. In this lamp 50, electrical wiring 58 extends into the base 52, through one of the tubes 56 and into a tube 60 that extends through the length of the pedestal 16 from the bottom to the top thereof, and it extends for a predetermined distance above the top of pedestal 16. An electric light socket and lightbulb 62 is mounted on the upper end of the tube 60, and a bracket 63 is attached to the top of tube 60 for holding a lampshade. A section 64 of the pedestal 16 is shown broken away to reveal the tube 60, and within the section 64, the tube 60 is shown broken away to reveal the electrical wiring 58.

Figure 7:
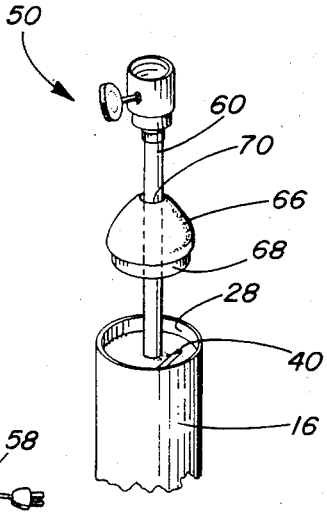
FIG. 7 is a partial detailed view of the top portion of the lamp shown in FIG. 6.

In this embodiment, a cap 66 is removably seated on the top of pedestal 16. The cap 66 is best shown in the detailed view of the top portion of the lamp 50 as shown in FIG. 7. In this view, it may be seen that the cap 66 includes a downwardly extending sleeve 68 that is dimensioned to fit snuggly within the recess 28. The outside diameter of the cap 66 at its base adjacent to the sleeve 68 is identical to the outside diameter of the pedestal 16 so that a smooth interface is formed between the cap 66 and the pedestal 16. The cap 66 also includes a aperture 70 dimensioned to receive the tube 60. Thus, the cap 66 may be slideably translated up and down the tube 60. When the cap 66 is mounted on the pedestal 16, it conceals the slot 40 that is contained within the recess beneath the cap 66. To gain access to slot 40 for the purpose of dropping money and the like into the slot 40, the cap 66 is simply raised upwardly along the tubing 60.

Figure 8:
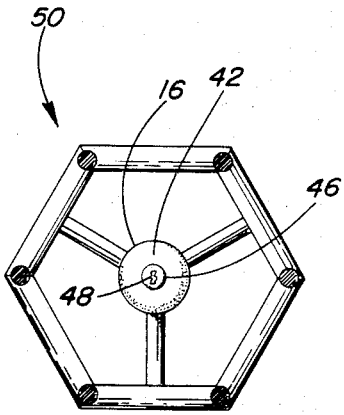
FIG. 8 is a bottom view of the lamp shown in FIG. 6.

Referring now to FIG. 8, there is shown a bottom view of the lamp 50. As with lamp 10, lamp 50 includes a circular inser 42 that fits within the pedestal 16 and is locked inside the pedestal 16 by a conventional locking mechanism 46 having a keyhole 48. To remove the insert 42 to gain acess to the chamber 32 within the pedestal 16, a key is inserted into the keyhole 48, the locking mechanism 46 is unlocked, and the insert 42 is removed from the pedestal 16.

Although two particular embodiments of the present invention have been described in the foregoing Detailed Description, it will be understood that the invention is capable of numerous modifications, rearrangements and substitutions of parts without departing from the scope of the invention.

I claim:

1. A lamp bank for receiving and conceiling money comprising:

a base for supporting the lamp bank;

a lamp socket to hold a light bulb for providing illumination;

a lamp pedestal extending from said base and for supporting said lamp socket;

said lamp pedestal having a chamber formed therein for containing money and concealing money for safekeeping;

an access port concealed and formed in said lamp pedestal for selectively accessing said chamber for removing money therefrom;

input means formed in said pedestal adjacent the top of said chamber of said pedestal for receiving and inputting money into said chamber; and means for concealing said input means in said pedestal.

2. In a lamp for providing illumination for other objects having a pedestal with a top and a bottom, the improvement comprising:

a chamber formed in said pedestal for receiving, conan access port concealed and formed in said pedestal for selectively accessing said chamber for removing money therefrom;

input means formed in said pedestal for receiving and inputting money into said chamber; and means for concealing said input means in said pedestal.

3. The apparatus of claim 1 further comprising:

lock means for selectively locking said access port to selectively prevent access to said chamber.

4. The lamp bank of claim 1 wherein said access port comprises:

an aperture formed in said lamp pedestal adjacent said base and extending through said pedestal to said chamber;

an insert dimensioned to fit snuggly within said aperture; and lock means for selectively locking said insert in said aperture.

5. The lamp bank of claim 1 wherein said input means comprises a slot formed in said lamp pedestal and extending therethrough from outside said pedestal to within said chamber.

6. The lamp bank of claim 1 wherein said input means comprises:

a recess formed in said pedestal;

a slot formed in said pedestal within said recess and extending through said pedestal into said chamber for inserting money into said chamber; and a plug dimensioned for snuggly fitting within said recess to conceal said slot.

7. The lamp bank of claim 1 wherein said input means comprises:

a cap removably seated on the top of said pedestal; and a slot formed in said pedestal positioned beneath said cap and extending through said pedestal into said chamber for inserting money into said chamber.

8. The lamp bank of claim 1 further comprising:

a rod extending from the bottom to and through the top of said pedestal and extending upwardly from the top of said pedestal for a predetermined distance;

said lamp socket being mounted on the upper end of said rod;

a cap removably seated on said pedestal;

an aperture formed in said cap for receiving said rod so that said cap may be raised from said pedestal and slidably translated along said rod; and a slot formed in said pedestal beneath said cap so that said cap conceals said slot but may be moved to expose said slot.

9. The lamp bank of claim 1 where said rod is tubular and further comprises electrical wiring extending from said base through said rod to said illuminating means so that money within said chamber is isolated from said electrical wiring by said tubular rod.

* * * * *

UNITED STATES PATENT AND TRADEMARK OFFICE

CERTIFICATE OF CORRECTION

PATENT NO. : 4,504,893

DATED : March 12, 1985

INVENTOR(S) : David B. Bostick, Sr.

It is certified that error appears in the above-identified patent and that said Letters Patent is hereby corrected as shown below:

Column 2, line 38, "Althought" should be -- Although --.

Column 4, line 12, "inser" should be -- insert --.

Column 4, line 15, "acess" should be -- access --.

Column 4, line 49, "conan" should be -- containing and concealing money for safe keeping; --.

Column 4, line 65, after "and" should begin a new paragraph.

Signed and Sealed this

Thirtieth Day of July 1985

[SEAL]

*Attest:*

DONALD J. QUIGG

*Attesting Officer* *Acting Commissioner of Patents and Trademarks*